US011458371B2

(12) United States Patent
Michelin

(10) Patent No.: US 11,458,371 B2
(45) **Date of Patent: *Oct. 4, 2022**

(54) NON-SPHERICAL GAME BALL AND METHOD OF USE

(71) Applicant: Lucas Michelin, New Castle, NH (US)

(72) Inventor: Lucas Michelin, New Castle, NH (US)

( * ) Notice: Subject to any disclaimer, the term of this patent is extended or adjusted under 35 U.S.C. 154(b) by 59 days.

This patent is subject to a terminal disclaimer.

(21) Appl. No.: 17/022,477

(22) Filed: Sep. 16, 2020

(65) Prior Publication Data

US 2020/0406108 A1 Dec. 31, 2020

Related U.S. Application Data

(63) Continuation of application No. 16/448,110, filed on Jun. 21, 2019, now Pat. No. 10,806,971.

(60) Provisional application No. 62/687,922, filed on Jun. 21, 2018.

(51) Int. Cl.
*A63B 43/00* (2006.01)
*A63B 39/00* (2006.01)

(52) U.S. Cl.
CPC ..... *A63B 43/002* (2013.01); *A63B 39/00* (2013.01)

(58) Field of Classification Search
CPC ..... A63B 43/002; A63B 39/00; A63B 39/08; A63B 37/00; A63B 43/02
See application file for complete search history.

(56) References Cited

U.S. PATENT DOCUMENTS 1,299,092 A * 4/1919 Abrahamson ..... A63B 43/002 473/595
1,644,466 A * 10/1927 Dewes ..... A63B 43/002 473/569
3,611,621 A * 10/1971 Folson ..... A63H 33/08 446/125
D235,157 S * 5/1975 Echterling ..... D21/498
D235,358 S * 6/1975 Dufaud ..... D21/707
D260,662 S * 9/1981 Hida ..... D21/498
D283,634 S * 4/1986 Kato ..... D21/498
D352,322 S * 11/1994 Mullaney ..... D21/707
D373,603 S * 9/1996 Moradinia ..... D21/373
5,758,604 A * 6/1998 J.o slashed.rgensen ..... A63F 9/0078 119/711
D437,010 S * 1/2001 Meys ..... D21/498
D466,164 S * 11/2002 Bensimon ..... D21/373
6,506,091 B1 * 1/2003 Garpow ..... A63H 33/08 206/216
D497,191 S * 10/2004 Shore ..... D21/709

(Continued)

FOREIGN PATENT DOCUMENTS

CH 226042 A * 3/1943 ..... A63B 43/002
FR 2024019 A5 * 8/1970 ..... A63B 37/0098

*Primary Examiner* — Steven B Wong
(74) *Attorney, Agent, or Firm* — Ellenoff Grossman & Schole LLP; James M. Smedley; Alex Korona

(57) ABSTRACT

A non-spherical ball includes a plurality of shaped components secured together and forming a body of the non-spherical ball; a cylindrical exterior shape extending around a first axis of the body; a cube exterior shape extending around a second axis of the body; the cylindrical exterior shape and the cube shape intersect at a right angle; and the cube exterior shape minimizes roll of the non-spherical ball when thrown on the second axis; and the cylindrical exterior shape maximizes roll of the non-spherical ball when thrown on the first axis.

19 Claims, 8 Drawing Sheets

(56) References Cited

U.S. PATENT DOCUMENTS

| | | | | | |
|---|---|---|---|---|---|
| D545,509 | S | * | 6/2007 | Wang | D30/160 |
| D563,486 | S | * | 3/2008 | Slater | D21/498 |
| D692,507 | S | * | 10/2013 | Meys | D21/502 |
| D771,750 | S | * | 11/2016 | Fjelstad | D21/373 |
| D869,561 | S | * | 12/2019 | Sladek | D21/373 |
| D896,899 | S | * | 9/2020 | Hochstrasser | D21/468 |
| 10,806,971 | B1 | * | 10/2020 | Michelin | A63B 39/00 |
| D934,968 | S | * | 11/2021 | Michelin | D21/707 |
| 2013/0074780 | A1 | * | 3/2013 | Wechsler | A01K 15/025 119/710 |
| 2015/0246266 | A1 | * | 9/2015 | Zawitz | A63B 39/08 473/570 |
| 2016/0325166 | A1 | * | 11/2016 | Wallace | A63B 69/0071 |
| 2018/0193696 | A1 | * | 7/2018 | Gwydir | A63B 24/0062 |

* cited by examiner

NON-SPHERICAL GAME BALL AND METHOD OF USE

CROSS REFERENCE TO RELATED APPLICATIONS

This application is a continuation and claims the benefit of U.S. patent application Ser. No. 16/448,110 filed Jun. 21, 2019 which claims the benefit of Provisional Application No. 62/687,922 filed on Jun. 21, 2018, the entire disclosures of which are incorporated herein by reference.

FIELD OF INVENTION

The present invention relates generally to balls, such as used for games and recreational activities, and more specifically to a ball that includes both a cylindrical exterior edge and a cube exterior edge to allow the user to adjust how the ball rolls based on the user's throw.

DESCRIPTION OF RELATED ART

Balls for use in games and recreational activities are well known in the art and include items such as footballs, basketballs, tennis balls, and the like. These items are commonly used for a particular sport and therefore include a very particular shape that is suitable for the sport. For example, a football is an oblong shape that is configured to fly through the air well, whereas a soccer ball is round, thereby allowing for the ball to roll easily.

One of the problems commonly associated with conventional balls is limited use. It is an object of the present invention to provide a ball that includes both a cylindrical exterior surface and a cubical exterior surface, along with a plurality of grips, thereby allowing for the user to throw, roll, and grip the ball as needed and desired for recreational activities.

Accordingly, although great strides have been made in the area of balls for sports and recreational use, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
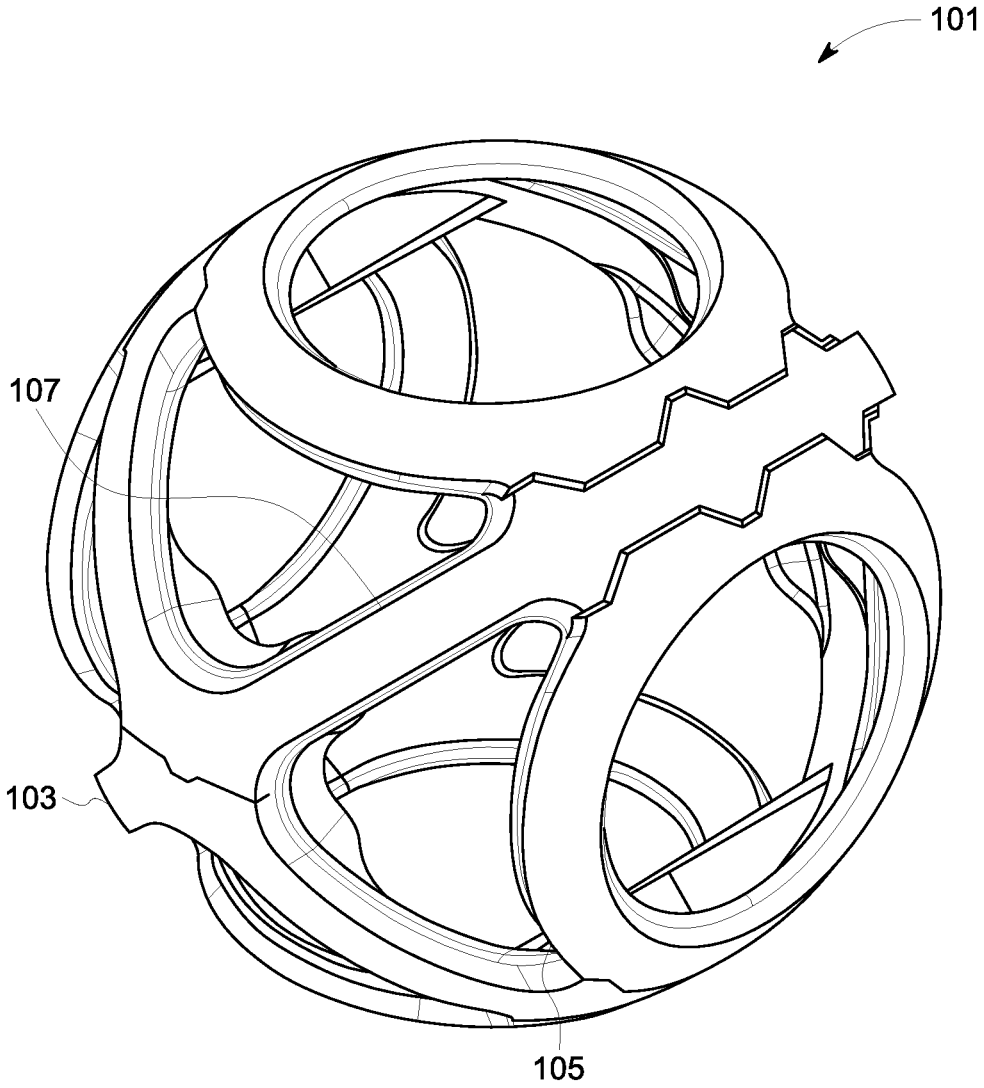
FIG. 1 is an isometric view of a ball in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional balls. Specifically, the present invention provides for a ball with a plurality of gripping locations and having different shapes, thereby providing for multiple uses of the ball. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-4 depict various views of a ball 101 in accordance with a preferred embodiment of the present application.

Figure 3:
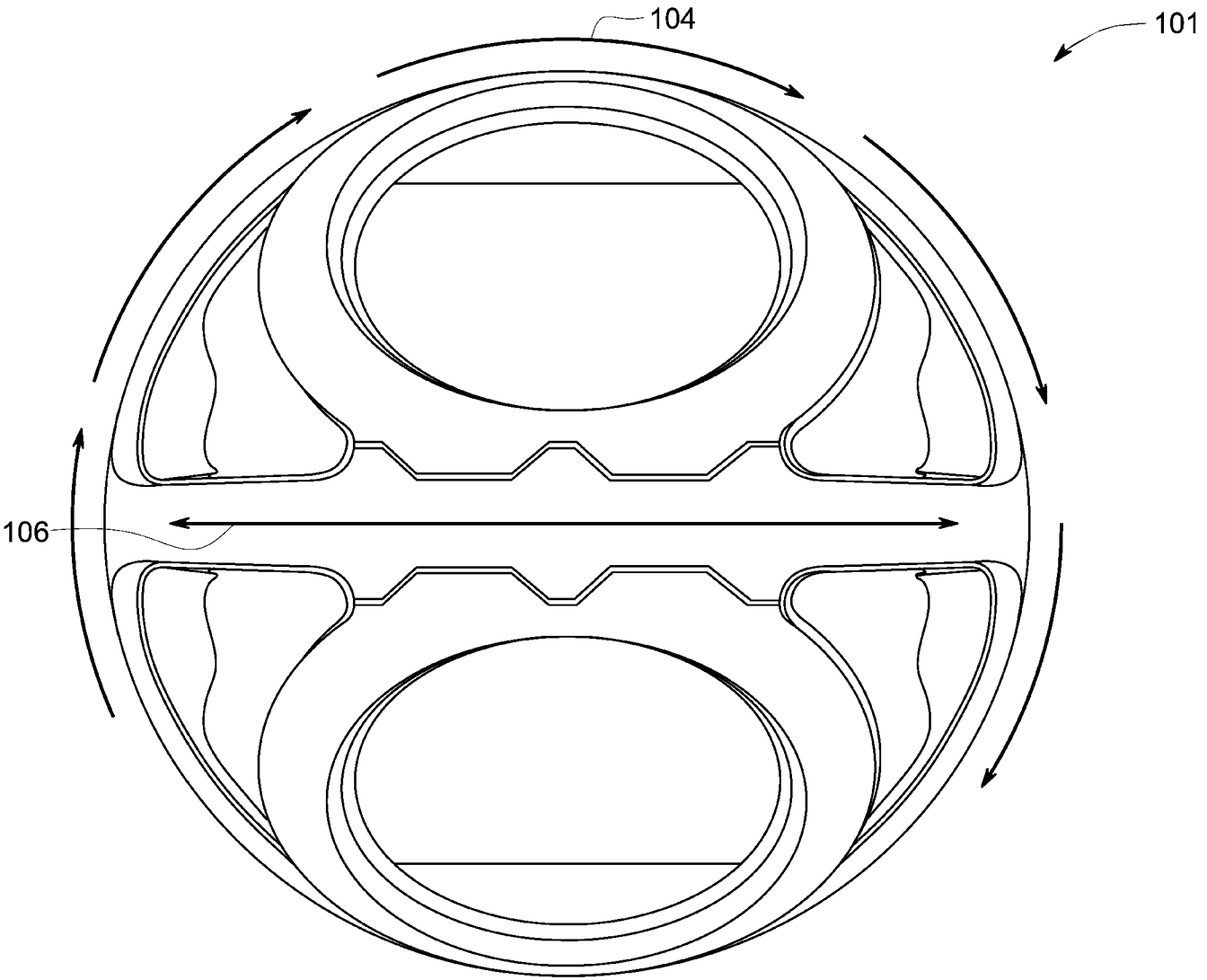
FIG. 3 is a second end view of the ball of FIG. 1.

In the contemplated embodiment, ball 101 includes a plurality of shaped components 103, 105, 107 secured together to form the body of the ball. In the preferred embodiment, the plurality of shaped components 103, 105, 107 are attached such that the ball includes a cylindrical exterior shape 104, 106, as shown in FIG. 3, and further includes a cube exterior shape 302 that travels a second axis of the body. In the preferred embodiment, the axis of the cube exterior shape and the axis of the cylindrical exterior shape intersect. As shown in FIG. 1, in some embodiments, the ball 101 may be a unitary member.

Figure 2:
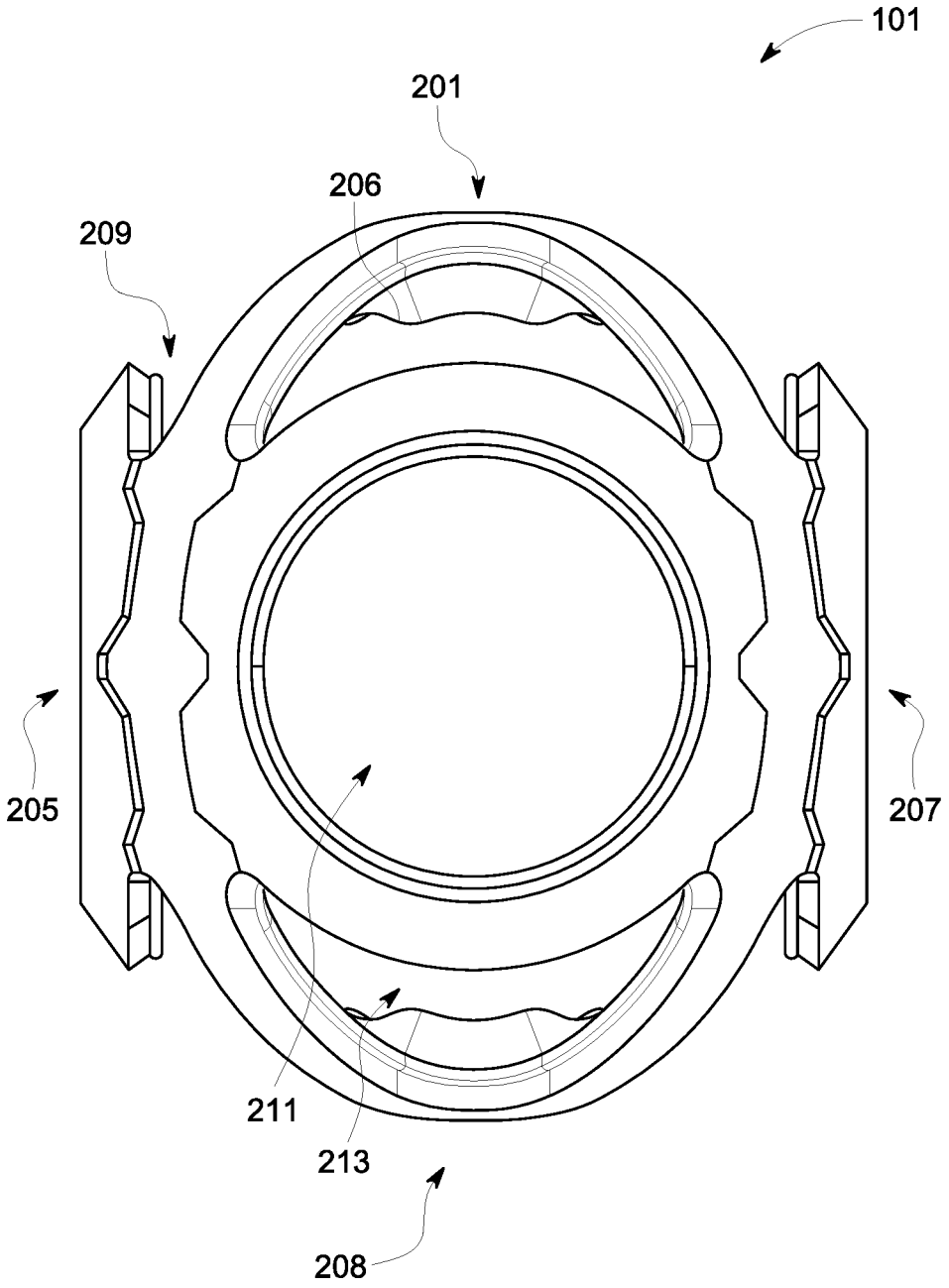
FIG. 2 is a first end view of the ball of FIG. 1.

As best shown in FIG. 2, the ball 101 further includes one or more substantially flat ends 205, 207 and one or more substantially curved ends 201, 208. The ball 101 having a plurality of openings 213 extending into an interior area 211. In some embodiments, the plurality of shaped components are attached such that one or more lips 209 are formed, thereby forming a gripping location for the user. Further, as shown, one or more interior lips 206 can extend inwardly to further provide for gripping locations for the user.

In FIG. 3, the ball 101 is shown in the configuration wherein two spherical paths 104, 106 are formed which follow the circumference of the ball. This allows the user to maximize roll along these paths.

Figure 4:
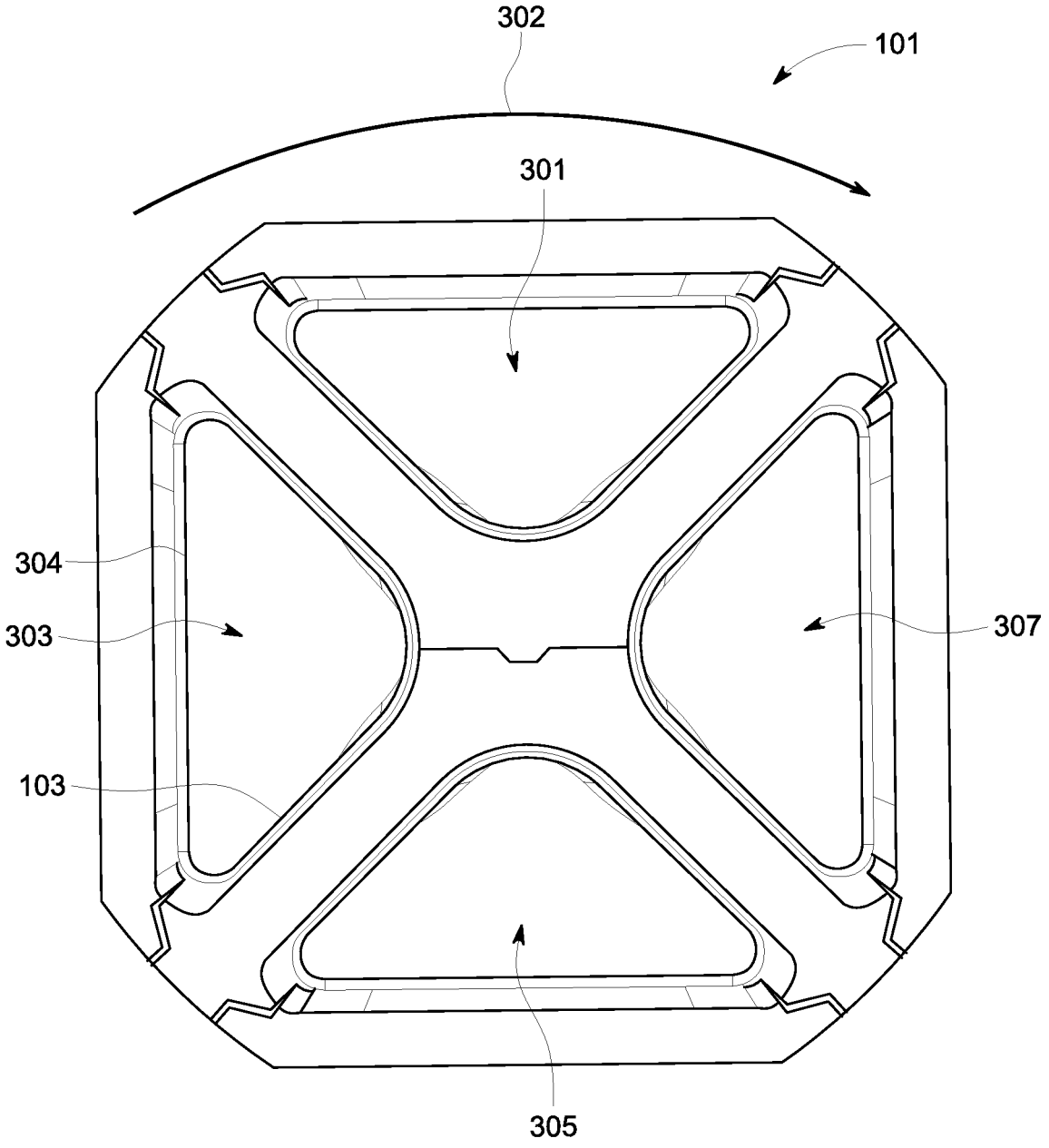
FIG. 4 is a third end view of the ball of FIG. 1.

As best shown in FIG. 4, the ball 101 can further include a plurality of triangular openings 301, 303, 305, 307 that extend into the interior area, further providing for a gripping location for the user. In some embodiments, one or more pieces of grip tape 304 are attached within the interior area of the ball, thereby further allowing for improved user grip. It should also be appreciated that the variously shaped openings allow for the user to grip as desired, such as with their entire hand, one or more fingers, or the like.

It should be appreciated that one of the unique features believed characteristic of the present application is the configuration of the ball that allows for the user to have multiple gripping locations, and the inclusion of both a cylindrical edge and a cube edge, wherein the cylindrical edge enhances rolling and the cube edge limits the rolling ability of the ball.

Figure 5:
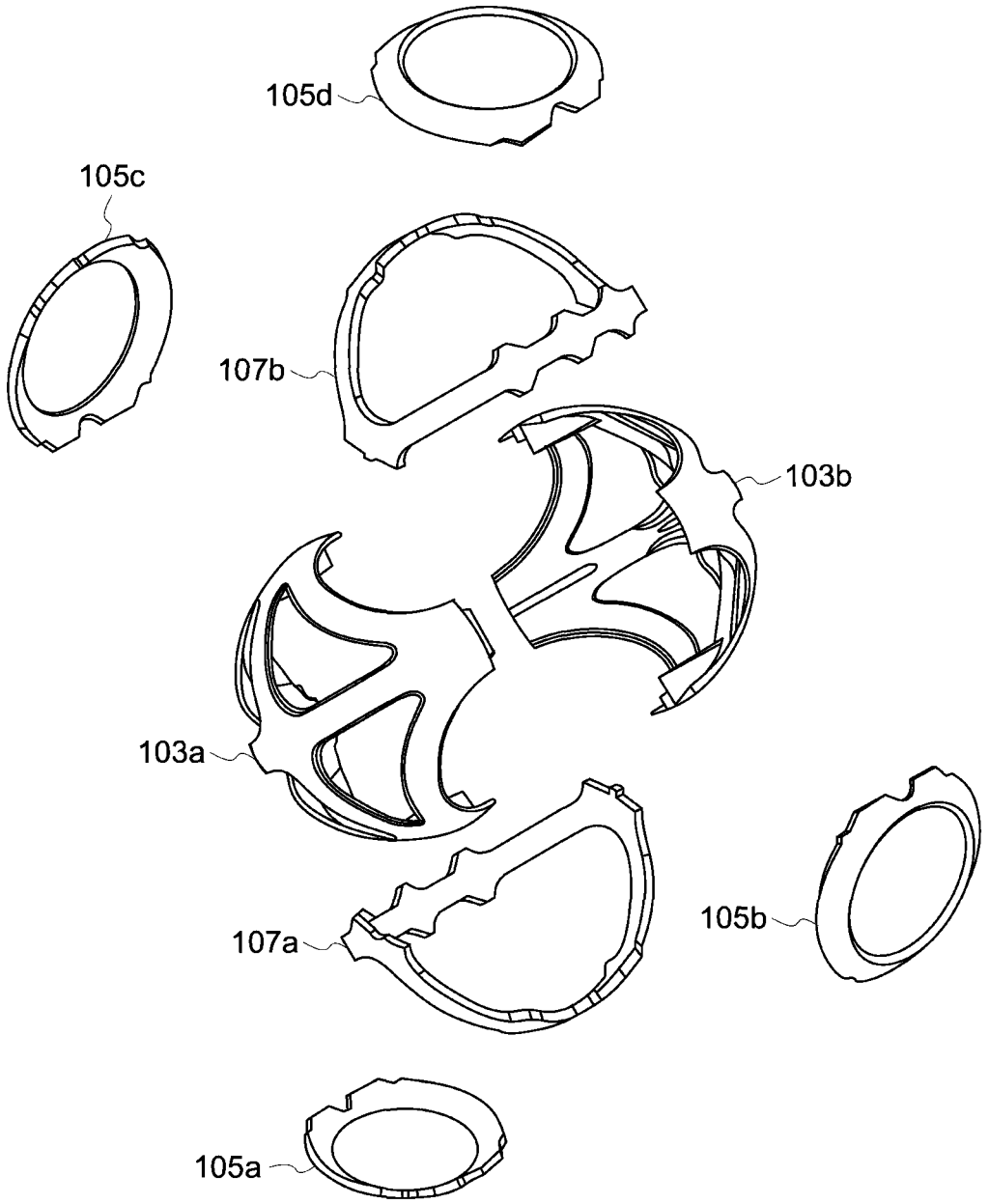
FIG. 5 is a disassembled view of the ball of FIG. 1.

In FIG. 5, a disassembled view of the ball is shown, wherein the ball includes four components 105*a-d*, two components 103*a-b*, and two components 107*a-b*. It should be appreciated that components 103*a-b* are interior structures of the ball. The remaining components 105*a-d*, 107*a-b* are soft pads to be attached to the exterior of the interior components 103*a-b*, as shown in FIGS. 1-4. In some embodiments, the four components 105*a-d* may be exterior pads that each have a substantially circular opening. As further shown in FIG. 5, in some embodiments, the two components 107*a-b* may be exterior pads that each have two band elements joined at their front and rear ends to form a substantially oval opening. It should be appreciated that the ball can function without the exterior pads.

Figure 6A:
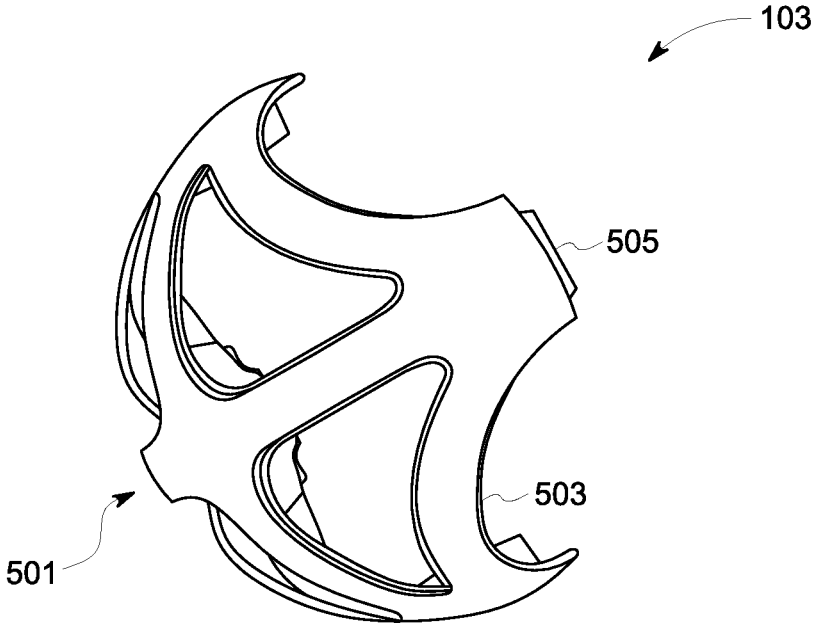
FIGS. 6A and 6B are isometric and front views of a first shaped component of the ball of FIG. 1.
Figure 6B:
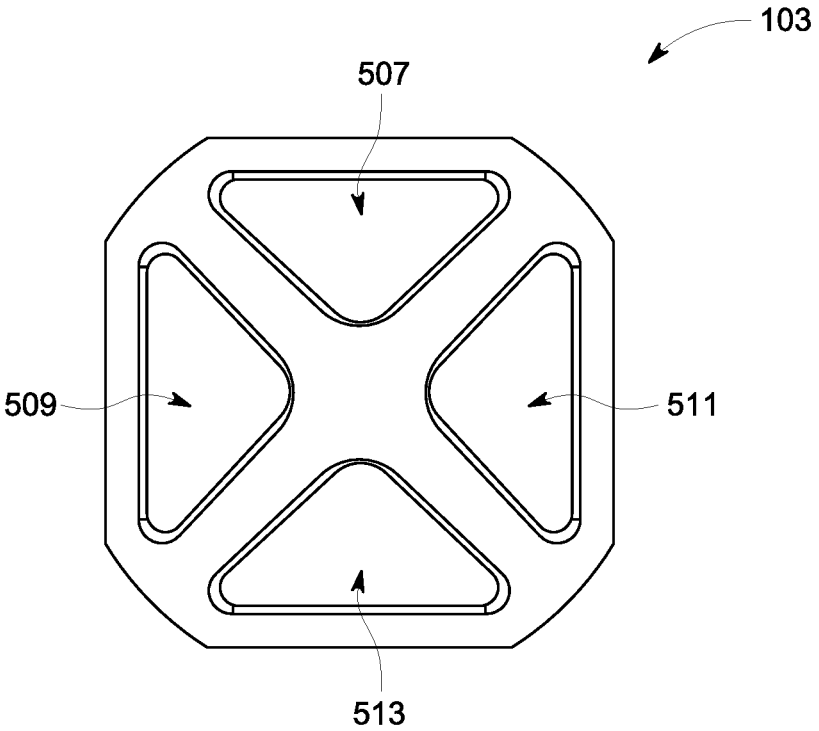

As further shown in FIG. 5, a non-spherical ball may comprise a body member comprising a pair of opposing rounded x-shaped components, each comprising a base portion with four curved arm members extending therefrom and connected to opposing x-shaped component arm members by rounded edge portions to form two spherical band members which intersect at two points, the base portions of each x-shaped component further comprising at least four notched sections, with each notched section having a protruding border forming a curved grip member, and four flat elements, each flat element formed with a circular opening and disposed between a pair of adjacent rounded edge portions to form at least two substantially triangular openings in the body member. As shown in FIGS. 1, 6A and 6B, in some embodiments, the two spherical bands may intersect at a 90 degree angle at each of the two points.

In FIGS. 6A and 6B, the first shaped component 103 (the inner scaffold) is shown. As shown, component 103 includes a first end 501 which curves down to a plurality of concave cutouts 503, wherein the plurality of concave cutouts 503 end in one or more tabs 505, the tabs 505 configured to secure to the other components to form a ball. As further shown, component 103 includes triangular openings 507, 509, 511, 513.

Figure 7A:
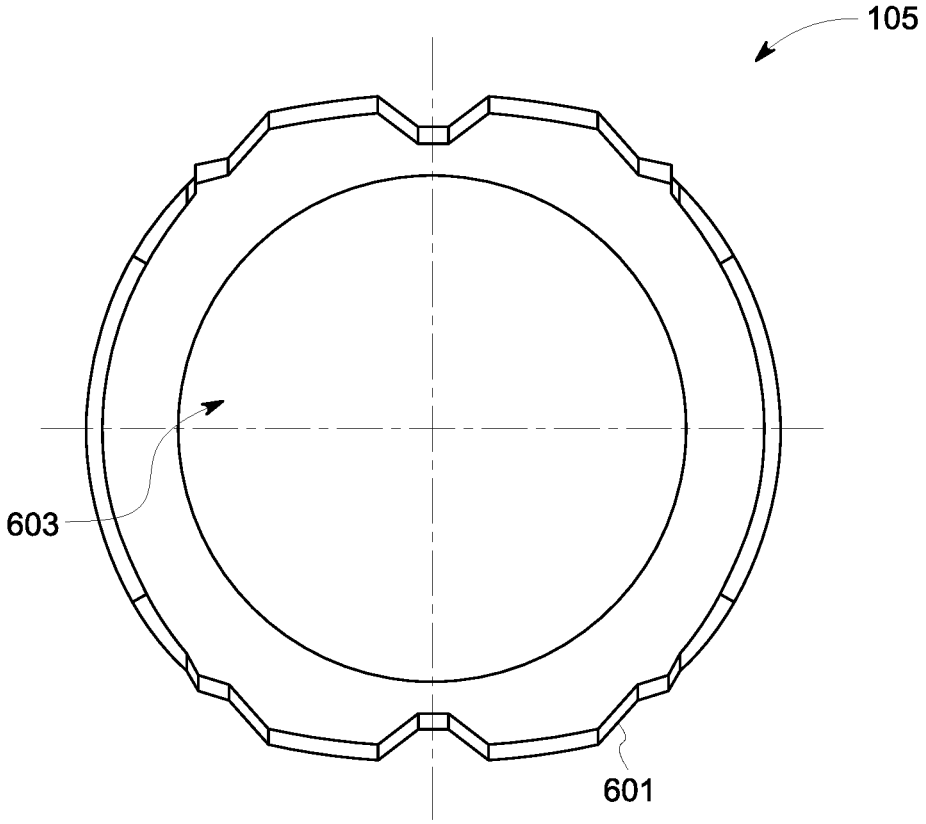
FIGS. 7A and 7B are end and side views of a second shaped component of the ball of FIG. 1.
Figure 7B:
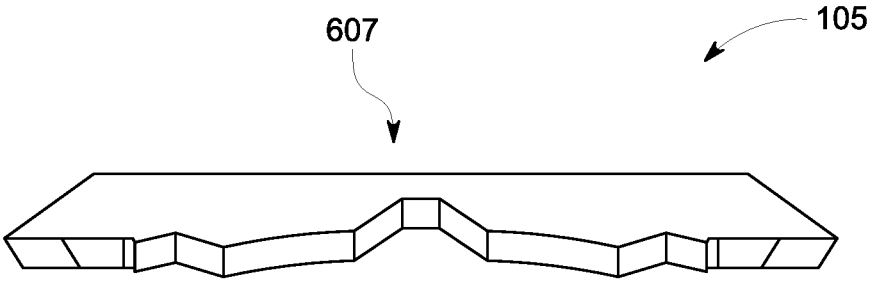

In FIGS. 7A and 7B, the second shaped component 105 (exterior pads) is shown. Component 105 includes a circular opening 603 and one or more tabs 601 that aid in securing component 105 to the plurality of other components. As further shown, component 105 includes a flat top 607.

Figure 8A:
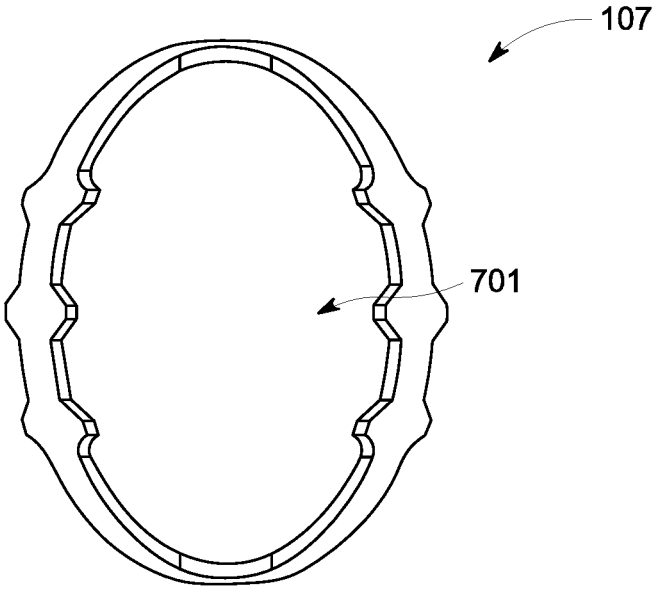
FIGS. 8A, 8B, and 8C are top and side views of a third shaped component of the ball of FIG. 1.
Figure 8B:
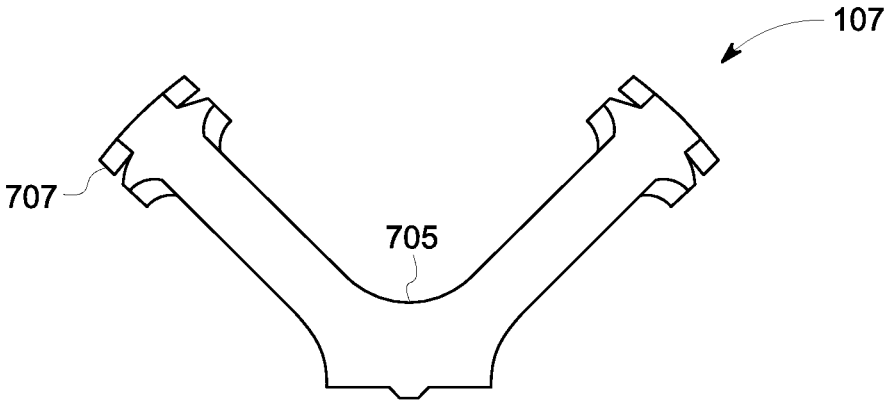
Figure 8C:
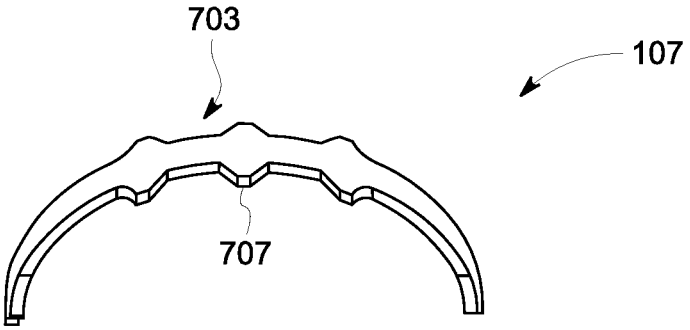

In FIGS. 8A and 8B, the third shaped component 107 (exterior pads) is shown, having a substantially oval opening 701. This component 107 is further in a V-shape, having a lower portion 705 that extends upward to one or more tabs 707 and grooves 703.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A non-spherical ball, comprising:

two first shaped components formed with one or more triangular openings, wherein the two first shaped components connect via one or more first tabs to form an inner scaffold;

four second shaped components each having a substantially circular opening;

two third shaped components each having two band elements joined at their front and rear ends to form a substantially oval opening; and wherein each of the second and third shaped components is configured to secure to said inner scaffold.

2. The ball of claim 1, wherein the two first shaped components form an inner support structure for the ball.

3. The ball of claim 1, wherein the second and third shaped components are exterior pads.

4. The ball of claim 3, wherein the second shaped components provide at least one flat exterior side surface.

5. The ball of claim 4, wherein the third shaped components provide at least one round exterior edge.

6. The ball of claim 1 further comprising one or more inner lip members configured to provide user grip.

7. A non-spherical ball, comprising:

a plurality of shaped components secured together and forming a body of the non-spherical ball;

a substantially round exterior shape extending around a first axis of the body;

a four-sided exterior shape extending around a second axis of the body, each side having a substantially flat face;

two inner scaffold components having triangular shaped openings and configured to secure together to form the ball;

four exterior pads having a substantially circular opening; and two exterior pads each having two band elements joined at their front and rear ends to form a substantially oval opening; and wherein the first and second axes intersect at a right angle.

8. The ball of claim 7, wherein the flat faces minimize roll of the non-spherical ball when thrown on the second axis, and the substantially round exterior shape maximizes roll of the non-spherical ball when thrown on the first axis.

9. The ball of claim 7, wherein the body has a plurality of openings extending into an interior area.

10. The ball of claim 7, wherein the body further comprises one or more lip members configured to provide user grip.

11. The ball of claim 7, further comprising one or more openings extending into an interior area of the ball and one or more pieces of grip tape disposed within the interior area and configured to provide user grip.

12. A non-spherical ball comprising:

a body member comprising a pair of opposing rounded x-shaped components, each comprising a base portion with four curved arm members extending therefrom and connected to opposing x-shaped component arm members by rounded edge portions to form two spherical band members which intersect at two points, the base portions of each x-shaped component further comprising at least four notched sections, with each notched section having a protruding border forming a curved grip member; and four flat elements, each flat element formed with a circular opening and disposed between a pair of adjacent rounded edge portions to form at least two substantially triangular openings in the body member.

13. The non-spherical ball of claim 12, wherein the two spherical band members intersect to form four quadrants of the body member, and each of the flat elements are disposed between a pair of adjacent rounded edge portions to form at least two substantially triangular openings in each quadrant.

14. The non-spherical ball of claim 12, wherein the two spherical bands intersect at a 90 degree angle at each of the two points.

15. The non-spherical ball of claim 12, wherein the flat elements minimize roll of the non-spherical ball when thrown on a first axis, and the two spherical bands maximize roll of the non-spherical ball when thrown on a second axis.

16. The non-spherical ball of claim 12, wherein the non-spherical ball is a unitary member.

17. The non-spherical ball of claim 12, wherein each rounded edge portion has an interior surface with a protrusion extending therefrom to form a straight grip member.

18. The non-spherical ball of claim 17, wherein the curved and straight grip members protrude towards a central interior portion of the non-spherical ball.

19. The non-spherical ball of claim 17, wherein the curved grip members are accessible through at least the triangular openings and the straight grip members are accessible through at least the circular openings of the flat elements.

* * * * *